US006237446B1

(12) United States Patent
Zhang

(10) Patent No.: US 6,237,446 B1
(45) Date of Patent: May 29, 2001

(54) WRENCH ADAPTER ASSEMBLY

(75) Inventor: Yong Ming Zhang, Barrington, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/427,248

(22) Filed: Oct. 26, 1999

(51) Int. Cl.[7] ..... B25B 13/50

(52) U.S. Cl. ..... 81/57.33; 81/120; 81/124.2; 81/180.1

(58) Field of Search ..... 81/57.33, 57.34, 81/57.15, 57.42, 120, 124.2, 180.1, 185, DIG. 11

(56) References Cited

U.S. PATENT DOCUMENTS

| | | | | |
|---|---|---|---|---|
| 171,353 | * | 12/1875 | Conway | 81/120 |
| 444,779 | * | 1/1891 | Greenamyer | 81/180.1 |
| 1,224,875 | * | 5/1917 | Zartj | 81/124.2 |
| 2,787,180 | | 4/1957 | Fish . | |
| 4,376,396 | | 3/1983 | Hayhoe . | |
| 4,631,990 | | 12/1986 | Hughes . | |
| 4,765,210 | | 8/1988 | Mierbach et al. . | |
| 4,942,792 | * | 7/1990 | Thornton | 81/124.2 |
| 5,365,807 | * | 11/1994 | Darrah et al. | 81/185 |
| 5,448,930 | * | 9/1995 | Miner et al. | 81/185 |
| 5,522,285 | | 6/1996 | Wilson, Jr. et al. . | |
| 5,881,612 | | 3/1999 | McCallops et al. . | |

* cited by examiner

*Primary Examiner*—Joseph J. Hail, III
*Assistant Examiner*—Joni B. Danganan
(74) *Attorney, Agent, or Firm*—Thomas B. McGurk; Middleton Reutlinger

(57) ABSTRACT

A wrench adapter assembly is provided that can adapt a conventional manual or power wrench to be used to grasp and rotate a smooth-surfaced cylindrical object. The wrench adapter assembly includes of a pivoting hook, a biasing means for the hook, a wrench adapter with a multisided flange for engaging the jaw of a wrench and a concave jaw. The pivoting hook is in circumferential alignment with the concave jaw so as to receive a smooth-surfaced cylindrical article. The flange shoulder has sides that match up with the sides of the jaw of the wrench. Once the wrench adapter assembly is secured within the wrench jaw, it may receive and hold a smooth-surfaced cylindrical article. The wrench adapter rotates with the jaw of the wrench. Thus, the wrench may be used in combination with the wrench adapter assembly to rotate smooth-surfaced cylindrical articles.

8 Claims, 3 Drawing Sheets

WRENCH ADAPTER ASSEMBLY

BACKGROUND OF INVENTION

1. Field of the Invention

This invention relates to wrench adapters and more particularly to wrench adapters that allow the use of a conventional wrench on smooth-surfaced cylindrical articles.

2. Discussion of the Prior Art

Many situations arise in manufacturing, industrial and maintenance settings wherein a smoothed-surfaced cylindrical article must be rotated at or near a use site. Examples of such cylindrical articles include plastic and metal piping, plastic and metal conduits, and hose. Wrenches have been the most common tools used in rotating or turning of cylindrical articles. The wrenches are generally used on articles with flat portions on their outer surface that allow for a secure grip with a wrench. However, conventional wrenches have traditionally been ineffective in use with smooth-surfaced cylindrical articles due to their inability to maintain a grip on such an article during rotation. As a result, manual rotation has been required in the past. It has been a laborious process that holds the risk of injury, including carpal tunnel syndrome, for those who undertake it. Thus, there is a present need in countless circumstances for a device that may adapt a conventional wrench to engage and hold a smooth-surfaced cylindrical article during rotation.

SUMMARY OF THE INVENTION

It is an object of the present invention to provide an adapter assembly for a wrench whereby the wrench may be used to hold and rotate a smooth-surfaced cylindrical article.

It is another object of the present invention to provide an adapter assembly that may be used with both manual and power-driven wrenches.

It is a further object of the present invention to provide an adapter assembly that may be used in clockwise or counterclockwise rotation.

More particularly, the present invention provides a wrench adapter assembly that may be inserted into a conventional manual or power wrench, and is designed to receive and hold a smooth-surfaced cylindrical article, such as conduit, piping, tubing or the like, which can then be rotated by the wrench. The wrench adapter assembly comprises: a wrench adapter; a hook; a bias means, such as a spring; at least one pivot pin for the spring and hook; and, at least one cover. The wrench adapter, preferably of arcuate shape, has a flange, a U-shaped slot, at least one channel and a plurality of apertures therein. The U-shaped slot extends from the adapter through the flange, as do the plurality of apertures. The U-shaped slot is aligned so as to receive a smooth-surfaced cylindrical article. The apertures are aligned parallel to the U-shaped slot and may contain smooth walls or threads within their inner surfaces. The flange, preferably of arcuate shape, has a shoulder that is designed to align with the faces of a wrench jaw that receives the adapter assembly. The hook may have at least one groove and/or edge within its concave inner surface and a sharpened tip adjacent to the end of one leg to assist in the holding of a smooth-surfaced cylindrical article. The hook also includes an aperture through which the pin extends to allow the hook to pivot. The spring is so aligned as to engage the hook and bias it in an open position, so as to receive a smooth-surfaced cylindrical body. The channel located within the adapter portion is aligned so as to receive one leg of the biasing mechanism, thereby providing a counterpoint to the biasing action of the mechanism. The adapter also contains another channel that is aligned so as to receive the top leg of the hook when the hook pivots inward.

The wrench adapter and cover can be arcuate or other convenient shape. The cover also contains a U-shaped slot and a plurality of apertures.

The components of the wrench adapter assembly may be fabricated from a metal, such as stainless steel or carbon steel, or other hard durable materials. The method of fabrication of the wrench adapter assembly may be by methods known to those skilled in the art such as machining, metalworking, or injection molding.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 3:
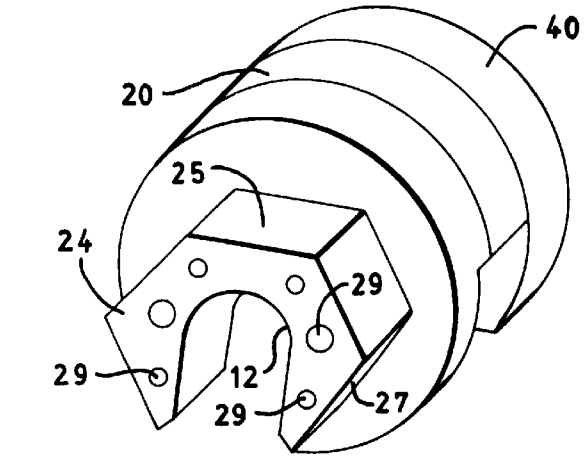
FIG. 3 is a perspective view of the wrench adapter of FIG. 1 showing a flange without the flange cover.
Figure 4:
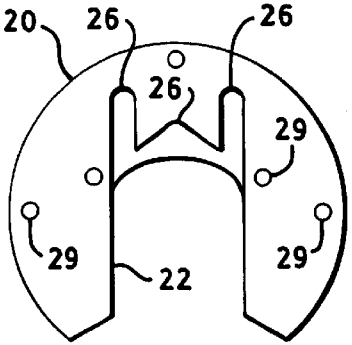
FIG. 4 is an end view of a wrench adapter of the preferred embodiment of the instant invention.
Figure 5:
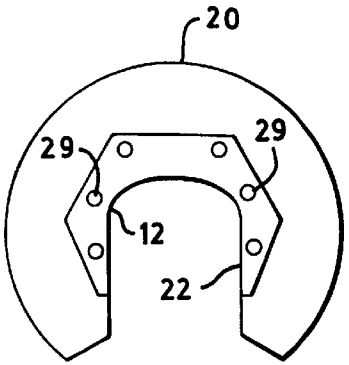
FIG. 5 is the opposing end view of the wrench adapter of FIG. 4.

As shown in the figures, a preferred wrench adapter assembly 10 of the present invention includes: an arcuate wrench adapter 20; an arcuate flange cover 30; an arcuate hook cover 40; a pivoting hook 50; a biasing means 60; at least one pivot pin 70; and, a plurality of threaded screws 81. The wrench adapter body 20 includes a U-shaped slot 22, a flange 24, at least one channel 26, and a plurality of apertures 29, as best shown in FIG. 4 and FIG. 5. The flange 24 projects out of the adapter body 20 parallel to the U-shaped slot 22. Flange 24 has a six-sided shoulder 25, as shown in FIG. 3. Each shoulder side 27 is sized so as to meet flush with the sides of the jaw of a wrench (not shown). Other embodiments of the wrench adapter 10 may have flange shoulders 25 with various numbers of sides so as to fit wrenches with different multisided jaws. Flange 24 also includes a U-shaped slot 12 extending the length of the flange 24. Flange 24 has a plurality of apertures 29 defined therein. The inner surfaces of the apertures 29 may be smooth or contain threads.

Figure 9:
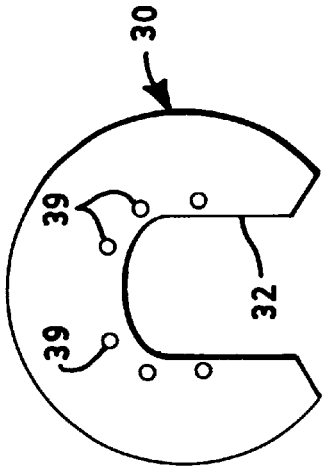
FIG. 9 is an end view of the flange cover of the wrench adapter assembly.

FIG. 9 shows the arcuate flange cover 30 which includes a U-shaped slot 32 and a plurality of apertures 39.

Figure 6:
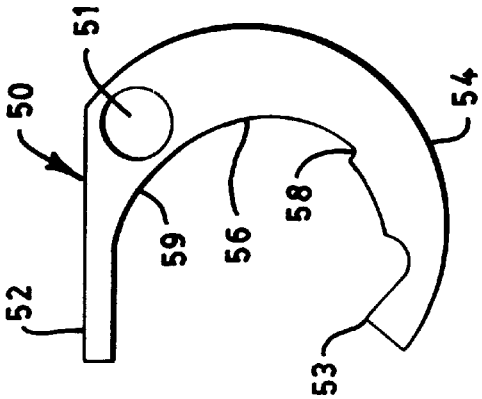
FIG. 6 is an end view of a hook of the wrench adapter assembly.

FIG. 6 shows the pivoting hook 50 has a top leg 52 and a drop leg 54. The two legs 52 and 54 define an inner concave surface 56. Within the concave surface 56 is one or more grooves 58 and one or more edges 59 to assist in the holding of a smooth-surfaced cylindrical article. The pivoting hook 50 also includes an aperture 51 that through the hook 50 parallel to the concave surface 56. The drop leg 54 includes a sharpened tip 53, located at the terminal edge of the concave surface 56, to assist in the holding of a smooth-surfaced cylindrical article.

Figure 10:
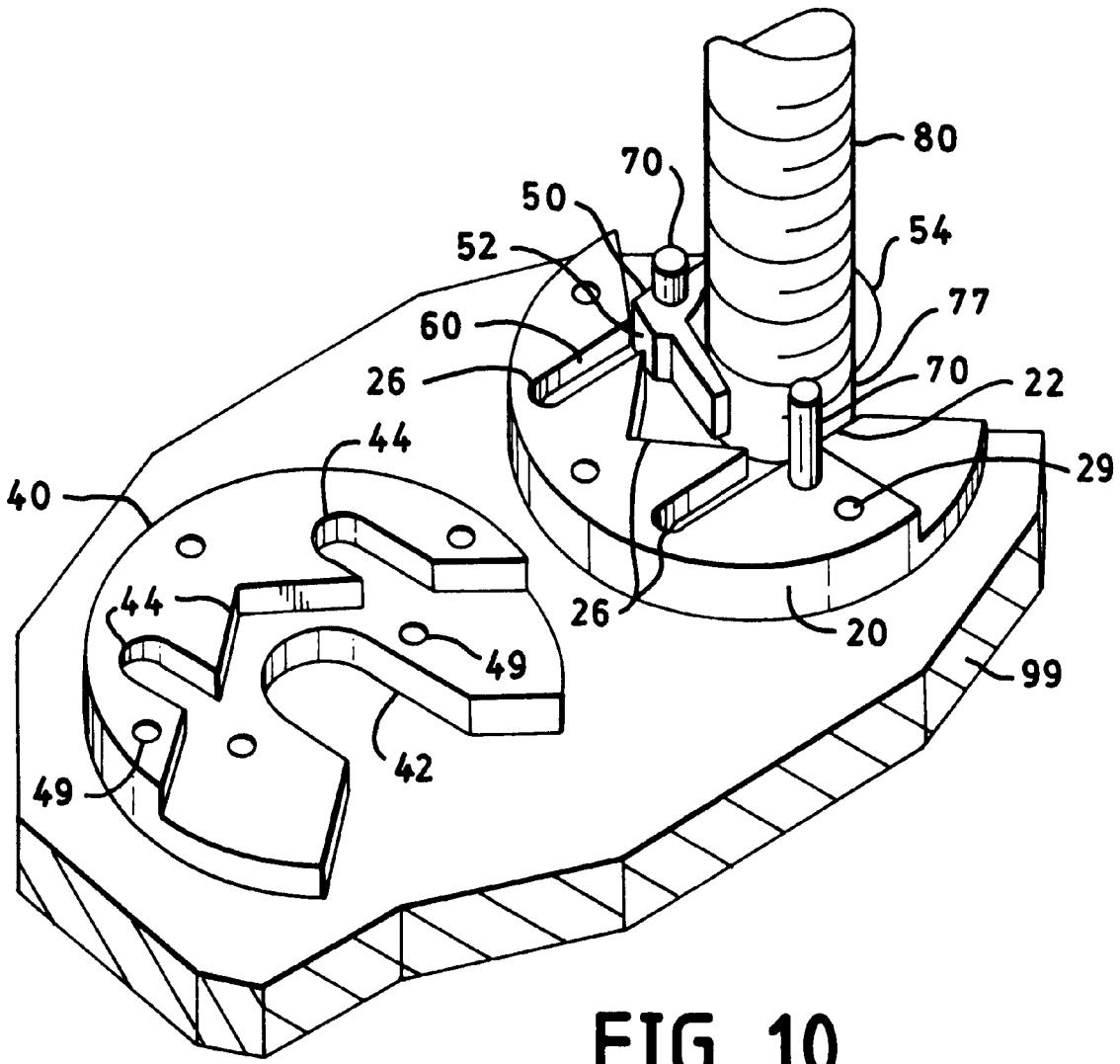
FIG. 10 is a perspective view of the wrench adapter assembly in fixed connection with a wrench and a smooth-surfaced article, the hook cover being removed and laid on top of the wrench, the fastening screws are not shown.

FIG. 10 shows that the arcuate hook cover 40 includes a U-shaped slot 42, at least one channel 44 and a plurality of apertures 49.

Figure 8:
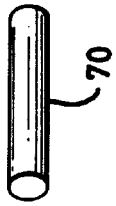
FIG. 8 is a perspective view of the pivoting pin of the preferred embodiment of the wrench adapter assembly.
Figure 7:
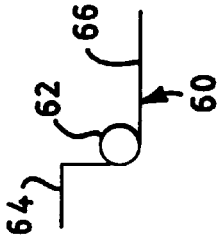
FIG. 7 is an end view of a biasing means of the wrench adapter assembly.

FIG. 8 shows a pivot pin 70 which is generally smooth-surfaced and cylindrical. In the preferred embodiment, the biasing means 60 is a torque spring, but other commonly known biasing means may be substituted for the spring described herein. The spring 60 has two legs in L-shaped configuration with a loop 62 at the intersection of the two legs, as shown in FIG. 7.

Figure 2:
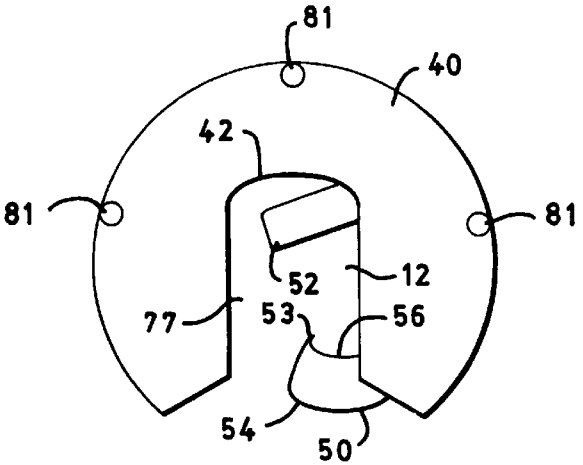
FIG. 2 is an end view of the wrench adapter assembly of FIG. 1.

When the aforementioned parts are assembled into the wrench adapter assembly 10, the pivoting pin 70 is inserted through the apertures in the flange cover 30, wrench adapter 20, and hook cover 40. The preferred embodiment contains two pivot pins 70 that extend through the apertures in the adapter and both covers when assembled, as shown in FIG. 10. The hook 50 may be positioned onto either one of the pivot pins 70, depending on whether the assembly 10 is to be used for clockwise or counterclockwise rotation. The hook 50 is circumferentially aligned with the U-shaped slot 12 in the adapter 20, as shown in FIG. 2. Between the wrench adapter 20 and the hook cover 40, the loop 62 of spring 60 is positioned onto pivoting pin 70 over which is placed hook 50. Hook 50 is pivotable about the axis of pivot pin 70. One leg 64 of spring 60 engages hook 50, while the other leg 66 engages channel 26 of wrench adapter 20. The spring 60 thereby biases the hook 50 to the open position, so that the hook 50 may receive a smooth-surfaced cylindrical object 80.

Figure 1:
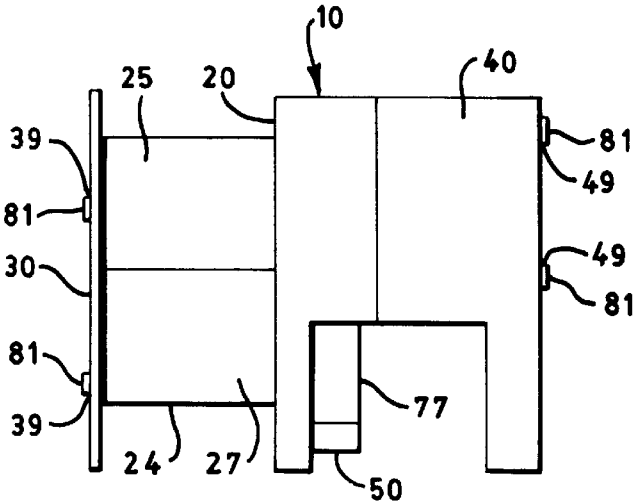
FIG. 1 is side view of a preferred embodiment of a wrench adapter assembly.

As shown in FIG. 1, flange cover 30 is abutted to flange 24 perpendicularly to flange shoulder 25. Hook cover 40 is placed over the hook 50 and spring 60 abutting the face of wrench adapter 20 opposite that of the flange 24, with the hook cover channels 44 facing the wrench adapter 20. Apertures 29, 39 and 49 in the adapter 20, flange cover 30 and hook cover 40, respectively, are aligned so that screws 81 may be threaded through the components so as to fasten the parts together, thereby forming the wrench adapter assembly 10. The U-shaped slots in each assembly component combine to form a concave jaw 77, wherein a smooth-surfaced article 80 may be received.

Once the wrench adapter assembly 10 is fastened together, it may be inserted into a wrench by bringing the flange shoulders 25 flush with the sides of the jaw of a wrench 99. Once the assembly 10 is secured within the wrench, a smooth-surfaced cylindrical article 80 may be received within the concave jaw 77 of the assembly 10. The biasing means holds hook 50 open to receive the smooth-surfaced cylindrical article within the concave jaw 77. Once the article is received, the hook 50 pivots inward, thereby securing the article within the assembly 10. The assembly 10 may then be rotated, either by rotating the entire wrench, in the case of a manual wrench, or by operating the jaw of the power wrench 99. The cylindrical article 80 rotates with the assembly 10. The hook 50 will engage the article 80 only when the assembly 10 is rotated in one direction, either clockwise or counterclockwise depending on which pivot pin 70 the hook 50 is placed. Thus, the wrench 99 may be rotated in the opposite direction to which the article is directed, thereby allowing for the threading of articles 80 in locations where full wrench rotation is not achievable.

It will be realized that various changes may be made to the specific embodiment shown and described without departing from the scope and spirit of the present invention.

What is claimed is:

1. A wrench adapter assembly comprising:

a wrench adapter having a U-shaped slot and a polygonal flange projecting from said wrench adapter parallel to said U-shaped slot, adapted to rotatably communicate in fixed connection with a jaw of a wrench;

a hook pivotally attached to an edge of said slot for pivotal movement toward a central axis through said slot; and, bias means for normally biasing said hook toward said edge.

2. The wrench adapter assembly of claim 1 further comprising:

at least one pin fixedly attached to said wrench adapter, said pin receiving said hook.

3. The wrench adapter assembly of claim 2 wherein said bias means is a torque spring concentrically attached to said pin and engaging said hook and said wrench adapter.

4. The wrench adapter assembly of claim 1, wherein said hook includes a sharpened tip.

5. The wrench adapter assembly of claim 1, wherein said hook includes at least one groove therein.

6. The wrench adapter assembly of claim 1, wherein said wrench adapter includes at least one channel therein.

7. The wrench adapter assembly of claim 1 further comprising:

a flange cover fixedly attached to said wrench adapter, having a U-shaped slot and at least one aperture therein; and, a hook cover fixedly attached to said wrench adapter, having a U-shaped slot, at least one aperture and at least one channel therein.

8. A device for engaging and rotating a smooth-surfaced cylindrical article comprising:

a wrench; and, a wrench adapter assembly comprising a wrench adapter having a U-shaped slot and a multisided flange projecting therefrom parallel to said U-shaped slot, adapted to rotatably communicate in fixed connection with a jaw of said wrench, a hook pivotally attached to said wrench adapter in circumferential alignment with said U-shaped slot, bias means for normally biasing said book toward an edge of said U-shaped slot.

* * * * *